United States Patent [19]

Honda

[11] 4,401,067

[45] Aug. 30, 1983

[54] VALVE PORTING FOR INTERNAL COMBUSTION ENGINE HAVING OBLONG CYLINDER

[75] Inventor: Shoichi Honda, Tokyo, Japan

[73] Assignee: Honda Giken Kogyo Kabushiki Kaisha, Tokyo, Japan

[21] Appl. No.: 282,655

[22] Filed: Jul. 13, 1981

[30] Foreign Application Priority Data

Jul. 14, 1980 [JP] Japan ..... 55-95979

[51] Int. Cl.[3] ..... F02F 3/28

[52] U.S. Cl. ..... 123/193 P; 123/90.27; 123/193 H; 92/177

[58] Field of Search ..... 123/193 R, 193 P, 193 H, 123/90.27, 315, 432; 92/177

[56] References Cited

U.S. PATENT DOCUMENTS

| | | | |
|---|---|---|---|
| 1,504,095 | 8/1924 | Burtnett | 123/315 |
| 2,257,417 | 9/1941 | Kelley | 92/177 |
| 2,409,555 | 10/1946 | Gadoux et al. | 92/177 |
| 3,164,143 | 1/1965 | Dolza | 123/90.27 |
| 3,219,019 | 11/1965 | Palmer | 123/90.27 |
| 3,441,012 | 4/1969 | Trammell | 123/193 P |

FOREIGN PATENT DOCUMENTS

| | | | |
|---|---|---|---|
| 511037 | 5/1952 | Belgium | 123/90.27 |

*Primary Examiner*—Craig R. Feinberg
*Attorney, Agent, or Firm*—Lyon & Lyon

[57] ABSTRACT

An internal combustion engine has an oblong piston sliding in an oblong cylinder bore and cooperating with a cylinder head to form an oblong combustion chamber. Intake and exhaust valves communicating with the combustion chamber are positioned in series in the direction of the length of the combustion chamber, each valve having a large head extending for substantially the whole width of the combustion chamber. Intake and exhaust passages communicating with the combustion chamber through the intake and exhaust valves extend away from the combustion chamber at right angles of the length thereof to minimize blow-by from the intake valve to the exhaust valve.

3 Claims, 4 Drawing Figures

VALVE PORTING FOR INTERNAL COMBUSTION ENGINE HAVING OBLONG CYLINDER

This invention relates to internal combustion engines of the type having a cylinder bore, a piston, and a combustion chamber which are not circular in cross section but which have an elliptical or oval or oblong cross section. Engines embodying this design have a very high ratio of output power per unit of weight. However, such engines may suffer from blow-by of air-fuel mixture from the intake valve to the exhaust valve, both communicating with the oblong combustion chamber. This blow-by occurs during the interval of valve overlap when both the intake valve and the exhaust valve are opened at the same time.

It is the principal object of this invention to provide an internal combustion engine having a piston, cylinder bore and combustion chamber which are all oblong and to place the intake and exhaust valves and passages to minimize blow-by during the valve overlap interval, and to increase the intake and exhaust efficiencies.

Other related and more detailed objects and advantages will appear hereinafter.

Figure 3:
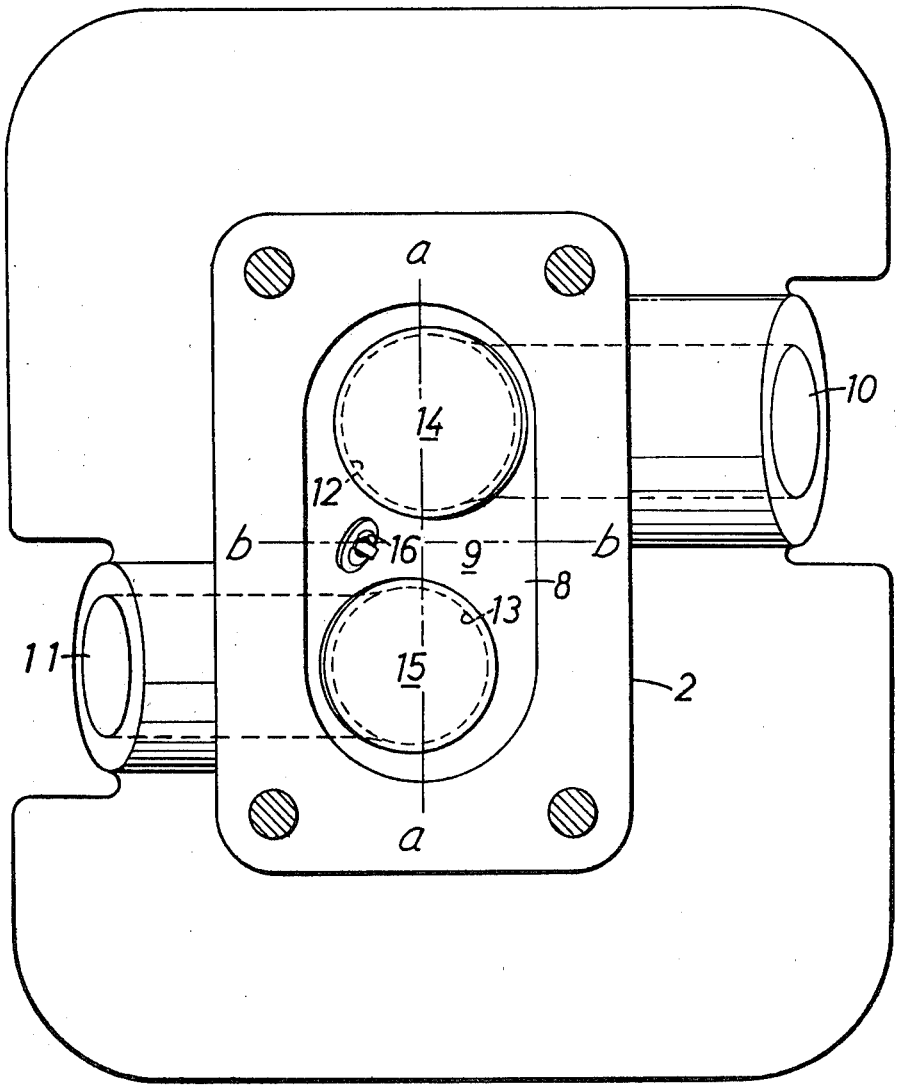
FIG. 3 is a view taken substantially on the lines 3—3 as shown on FIG. 1.

Referring to the drawings, the cylinder block 1 of an internal combustion engine is secured to a cylinder head 2, with a gasket 3 between them. The cylinder bore 4 is not cylindrical; it is oval or elliptical or oblong in cross section, its long axis being designated a—a as shown on FIG. 3. The transverse short axis b—b is also shown. The oblong piston 5 is shaped for sliding contact with the oblong bore 4 and is provided with a single piston pin 6 which is engaged by two piston rods 7. The piston rods 7 are connected to the crank shaft (not shown) which is parallel to the piston pin 6 and to the long axis a—a.

The piston 5 and the combustion chamber wall 8 in the cylinder bore 4 cooperate to define a combustion chamber 9 of the same general oblong shape as the cylinder bore 4 and the piston 5. The intake port 10 and the exhaust port 11, both in the cylinder head 2, communicate with the combustion chamber 9 through the intake valve opening 12 and the exhaust valve opening 13, respectively. The intake valve 14 closes the intake valve opening 12 and the exhaust valve 15 closes the exhaust valve opening 13. The intake port 10 and the exhaust port 11 are each parallel to the short axis b—b and extend in opposite directions from the long axis a—a. The intake valve 14 and the exhaust valve 15 are both of the poppet type and are serially arranged in the direction of the long axis a—a.

Figure 1:
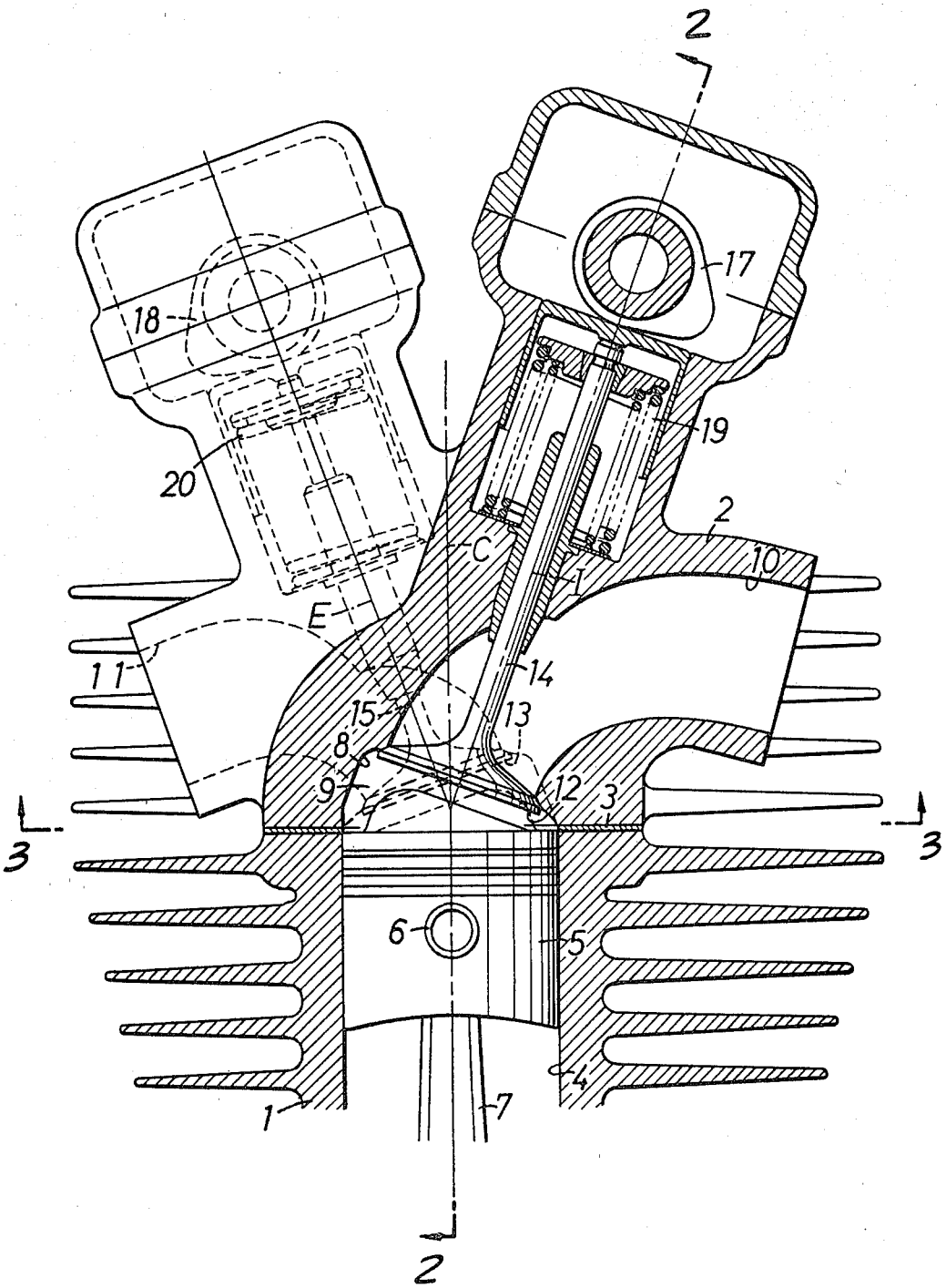
FIG. 1 is a sectional side elevation taken substantially on the lines 1—1 as shown on FIG. 2, and showing a preferred embodiment of this invention.
Figure 2:
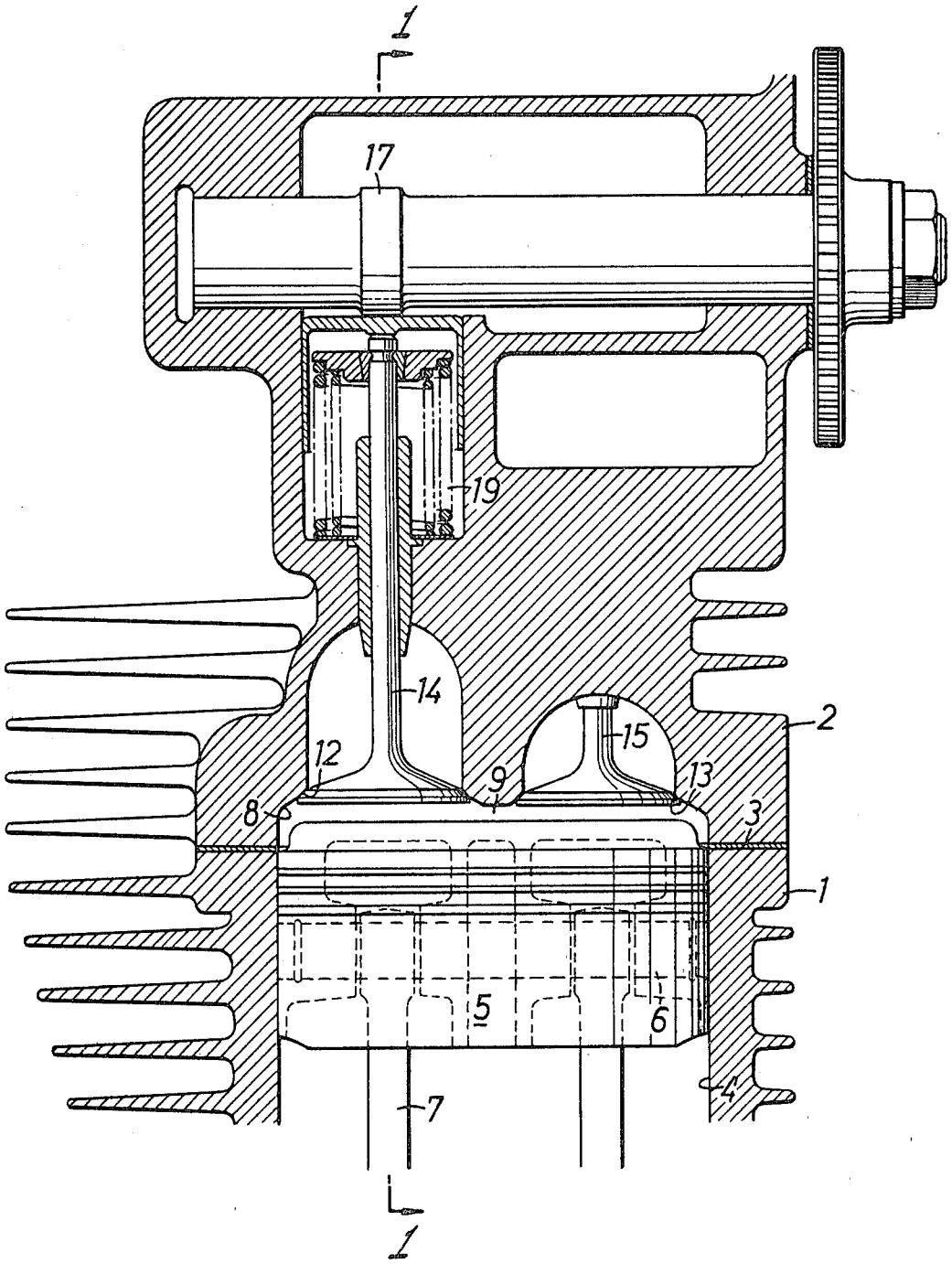
FIG. 2 is a sectional view taken substantially on the lines 2—2 as shown on FIG. 1.

The central axis C of the cylinder bore 4 and piston 5 passes through the center of the combustion chamber 9. The axis I of the intake valve 14 and the axis E of the exhaust valve 15 are inclined in opposite directions with respect to the central axis C of the piston 5, as best shown in FIG. 1. A rotary cam 17 opens the intake valve 14 in opposition to the spring 19, and a rotary cam 18 opens the exhaust valve 15 in opposition to the valve spring 20. The ignition plug 16 extends into the combustion chamber 9 at a location between the valves 14 and 15 and at one side of the long axis a—a.

In operation of the internal combustion engine, the fresh air-fuel mixture passing through the intake port 10 during the intake stroke of the engine flows into the combustion chamber 9 when the intake valve 14 is open. This fresh air-fuel mixture thus introduced impinges directly upon the combustion chamber side wall 8 and then flows toward the center portion of the combustion chamber 9. Only a very small quantity of fresh air-fuel mixture escapes through the exhaust port 11 as blow-by, even during the overlap interval when the valves 14 and 15 are open at the same time.

Figure 4:
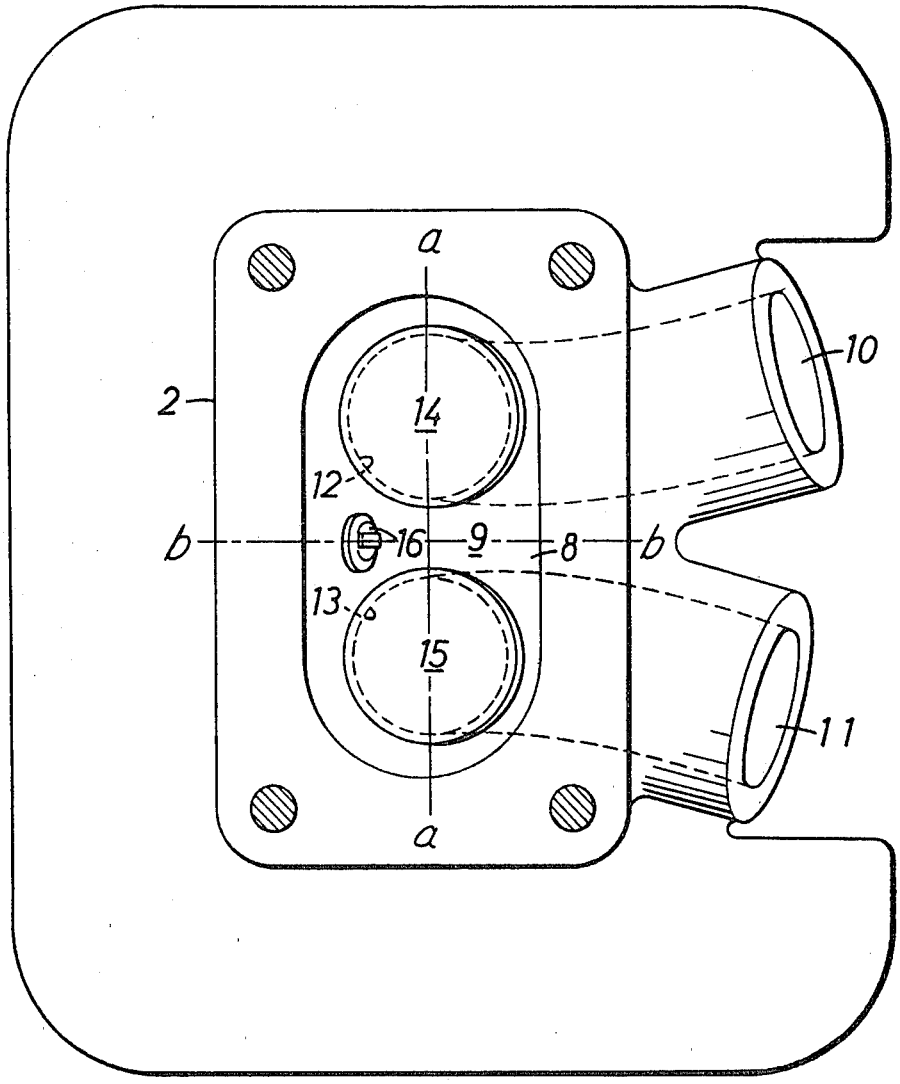
FIG. 4 is a view similar to FIG. 3 showing a modification.

In the modification shown in FIG. 4, the intake and exhaust ports 10 and 11 extend from the same side of the cylinder head 2, and they are symmetrical with respect to the short axis b—b. Accordingly, direct passage or blow-by of the fresh air-fuel mixture from the intake valve opening 12 to the exhaust valve opening 13 is minimized during the overlap interval of the intake valve 14 and exhaust valve 15.

Since the piston 5, cylinder bore 4, and combustion chamber 9 are all elliptical or oval or oblong in cross section, and since the intake and exhaust valves are positioned in series in the direction of the long axis of the combustion chamber, the diameter of the poppet portions of the intake and exhaust valves can be made very large in proportion to the width of the cylinder bore 4 along the short axis b—b. As compared to the conventional internal combustion engine having a cylinder bore circular in cross section and having a pair of intake and exhaust valves, the ratio of the area of the end of the poppet portion of each valve to the cross sectional area of the cylinder bore is greatly increased. Consequently, the flow resistance of the conduits of the intake and exhaust systems can be materially decreased. This permits enhancement of the intake and exhaust efficiencies to improve the output performance of the internal combustion engine.

Moreover, since the intake and exhaust valves are arranged in series order in the direction of the long axis a—a of the cross section of the combustion chamber, whereas the intake and exhaust ports are positioned in parallel in the direction of the short axis b—b, the fresh air-fuel mixture passes into the combustion chamber out of the intake port and impinges on the combustion chamber wall, changing its flow direction until it flows toward the center portion of the cylinder bore. Loss of fresh air-fuel mixture from the intake valve directly to the exhaust valve during the overlap interval is thus minimized. The result is an improvement in fuel economy and reduction of the discharge of unburned or partially burned gases through the exhaust system and into the atmosphere.

Having fully described my invention, it is to be understood that I am not to be limited to the details herein set forth but that my invention is of the full scope of the appended claims.

I claim:

1. An internal combustion engine comprising a cylinder, oblong in cross section with a long axis and a short axis;

a piston, oblong in cross section and mounted to slide in said cylinder;

a cylinder head closing said oblong cylinder;

an intake poppet valve;

an exhaust poppet valve, said intake and exhaust poppet valves being positioned in said head to communicate with said combustion chamber, being arranged in series in the direction of the long axis, being inclined with respect to said long axis, and each having a valve body extending on both sides of the long axis;

an intake passage and an exhaust passage in said cylinder head communicating with said oblong combustion chamber through said intake and exhaust valves respectively, said intake and exhaust passages extending away from said long axis in the direction of inclination of said intake and exhaust valves respectively, said intake and exhaust valves further being arranged to move toward the plane of said long axis upon opening;

and further including a spark plug located through said head between said valves and displaced from the plane of said long axis in a direction opposite to the inclination of said intake valve.

2. The internal combustion engine of claim 1 wherein said intake valve and said exhaust valves are inclined in opposite directions from the plane of said long axis.

3. The internal combustion engine of claim 1 wherein said intake and exhaust valves are inclined in the same direction from the plane of said long axis.

* * * * *